United States Patent [19]

Amoroso

[11] 4,119,346

[45] Oct. 10, 1978

[54] LONGWALL MINING SYSTEM

[75] Inventor: Michael J. Amoroso, Marion, Ill.

[73] Assignee: M.A.T. Industries, Inc., West Frankfort, Ill.

[21] Appl. No.: 792,974

[22] Filed: May 2, 1977

[51] Int. Cl.[2] ..... E21C 27/24; E21D 23/00

[52] U.S. Cl. ..... 299/11; 299/31; 299/43; 299/89; 405/294

[58] Field of Search ..... 299/11, 31, 33, 43, 299/51-54, 71, 89; 61/45 D

[56] References Cited

U.S. PATENT DOCUMENTS

| | | | |
|---|---|---|---|
| 2,699,327 | 1/1955 | Cartlidge | 299/89 |
| 2,716,025 | 8/1955 | Malloy et al. | 299/11 |
| 3,006,624 | 10/1961 | Doxey | 299/89 X |
| 3,097,829 | 7/1963 | Seddon | 299/31 X |
| 3,356,417 | 12/1967 | Heyer et al. | 299/54 X |
| 3,399,927 | 9/1968 | Groetschel | 299/43 X |
| 3,856,356 | 12/1974 | Allen et al. | 299/11 |

FOREIGN PATENT DOCUMENTS

| | | | |
|---|---|---|---|
| B27,983 | 11/1956 | Fed. Rep. of Germany | 61/45 D |
| 53,291 | 5/1967 | Poland | 299/43 |

*Primary Examiner*—Ernest R. Purser
*Assistant Examiner*—Nick A. Nichols, Jr.
*Attorney, Agent, or Firm*—Cohn, Powell & Hind

[57] ABSTRACT

This mining system utilizes a row of roof support units in conjunction with a row of conveyor sections and a continuous mining machine which rides on the conveyor sections. Each roof support includes a primary support shield supported on a base by means of jacks and a secondary support shield telescopically mounted to the primary support shield and having a wall engagement portion at the outer end to provide bearing support for the secondary support shield by the wall rather than merely by cantilever support. Each support unit is connected to an associated conveyor unit by a ram for moving said units relative to each other. The mining machine includes a kerf cutting member for creating a continuous ledge at the junction of the longwall and roof for supporting the secondary support shield wall engagement portion.

14 Claims, 11 Drawing Figures

100a
100b
100c
100d
100e
100f
100g
100h
100i
100j
120a
120b
120c
120d
120e
120f
120g
120h
120i
120j
200a
200b
200c
200i
200j
102
116
117
14
21'
22'
32
315
317
101
10

10
21
22
23
100h
102
104
106
107
111
116
117
118
120
200h
315
316
317
320

14
21
22
23
11
117
116
101
320
317
315
316
118
102
104
107
111
120
19
100a
100b
100c
100d
100e
100f
100g
100h
100i
100j
100k
100l
100m
120a
120b
120c
120d
120e
120f
120g
120h
120i
120j
120k
120l
120m

LONGWALL MINING SYSTEM

BACKGROUND OF THE INVENTION

This invention relates to a longwall mining system and particularly to extensible roof support units supported at their outer end by the longwall.

Longwall mining systems presently in use commonly utilize mining machines having single or double drum shearers operating above an armored conveyor along a face which is typically six hundred feet long. The roof is supported in the vicinity of the longwall face by self-advancing fixed cantilever beam supports and the roof is caved in behind the supports. This system is satisfactory in geographic areas where the roof is good. However, in those areas where the roof condition is bad the roof tends to collapse at the juncture of the roof and the wall face where insufficient support is provided between the end of the cantilever beam supports and the wall face.

When a two pass shearer makes a pass, it exposes an unsupported lengthwise extending portion of the roof immediately adjacent the wall and extending the full length of the wall. The fixed cantilever beam supports cannot advance into the newly cut face until after the second pass is made. Even then the cantilever beam supports lag a considerable distance behind the continuous mining machine because the conveyor sections must include a transitional length several sections long.

Telescoping beams have been used for roof support systems but have not proven satisfactory because extremely long cantilever lengths are required which must be of considerable strength to carry the heavy roof loads in the vicinity of the longwall face. When a cantilever beam, ie a beam supported at one end and unsupported at the other end, is loaded along its entire length, the maximum bending moment that it sustains is four times the maximum bending moment sustained by a simply support beam, ie a beam supported at each end, which carries the same load. The only known attempt to provide support for a roof system at the wall end is disclosed in U.S. Pat. No. 2,716,025. However, the system disclosed in this patent has evidently not found general acceptance. There appear to be several reasons for this. One is that a belt conveyor is used which cannot be advanced in sections, as can an articulated conveyor. Further, the mining machine itself is used to provide temporary support for the roof when the machine is passing by, which presupposes an exactness of roof support elevational alignment not common in mining. In addition, it appears that the relatively movable secondary portion of the roof support must be carried by a separate base unit which results in clearance problems. Finally, the operation appears to be manual and there is no suggestion of how it can be adapted to current mining procedures.

The present longwall mining system overcomes these and other problems in a manner neither disclosed nor suggested in the known prior art.

SUMMARY OF THE INVENTION

This longwall mining system provides roof support in the vicinity of the wall face, in the area of mining machine operation. The support is provided by an extensible secondary support, which is engageable with and supported by the wall to provide the secondary support with "simple beam" rather than "cantilever beam" support characteristics and relieves excessive roof pressure which exists when the material mined is removed.

The system includes articulated conveyor sections which cooperate with the roof support system to ensure the effectiveness thereof, and is adaptable for use with double pass and single pass mining procedures with a minimum unsupported roof area at a given time.

This longwall mining system includes a plurality of mine roof supports each having a base means, a primary support means having a telescopically mounted secondary support means engageable with the longwall at the outer end and jacking means between the base means and the primary support means for elevating the primary support means.

The system includes conveyor means providing a plurality of articulated conveyor sections each conveyor section being connected to an associated ram means for movement of said conveyor section toward the longwall when the associated base means is fixed in position and for movement of the base means toward the longwall when the conveyor section is fixed in position.

This longwall mining system provides a continuous mining machine carried by the conveyor sections and including a kerf cutting means to create a bearing ledge along the upper portion of the longwall the secondary support means having an outer end movable into bearing engagement with the bearing ledge.

The system can utilize a continuous mining machine having a single pass drum cutter means with a vertical axis of rotation or a double pass drum cutter means having a horizontal axis of rotation.

When used with a single pass drum cutter means the kerf cutting means is provided by a cylindrical member having a vertical axis of rotation coaxial with the drum cutter means. When used with a double pass drum cutter means a cylindrical kerf cutter means having a vertical axis of rotation is used which is spaced lengthwise from the drum cutter means.

This longwall mining system provides a method of supporting the roof during a continuous mining operation which comprises the steps of laying an articulated conveyor adjacent the longwall face; supporting the roof adjacent the longwall by a plurality of extensible roof supports; cutting the longwall face with a continuous mining machine traveling lengthwise on the articulated conveyor; extending the roof support beyond the newly cut longwall face and into supporting engagement with the longwall after the machine has passed and progressively relocating the conveyor sections into closer adjacency with the newly cut longwall face when the machine has passed.

The longwall mining system also provides a method of supporting a roof during a two pass mining operation comprising the steps of laying an articulated conveyor adjacent the longwall face; supporting the roof adjacent the longwall face by a plurality of extensible roof supports; making the first upper pass with a continuous mining machine traveling lengthwise on the articulated conveyor; extending the roof support beyond the newly cut longwall face and into supporting engagement with the longwall after the machine has passed; making a return, lower pass with the continuous mining machine traveling lengthwise on the articulated conveyor and progressively relocating the conveyor sections into closer adjacency with the newly cut longwall face when the machine has passed.

The system provides a particularly desirable feature in that when the extensible roof supports move into engagement with said longwall, the longwall not only assists supporting the roof load, but substantially reduces the load concentration which would otherwise be transferred to the floor from the roof. This is particularly important in the case of mines with soft bottom such as is quite common in the U.S.A.

BRIEF DESCRIPTION OF THE DRAWINGS

FIG. 8 is a plan view of a longwall mining system illustrating the first pass of a modified kerf cutter used in conjunction with a two-pass drum shearer;

DESCRIPTION OF THE PREFERRED EMBODIMENT

Figure 1:
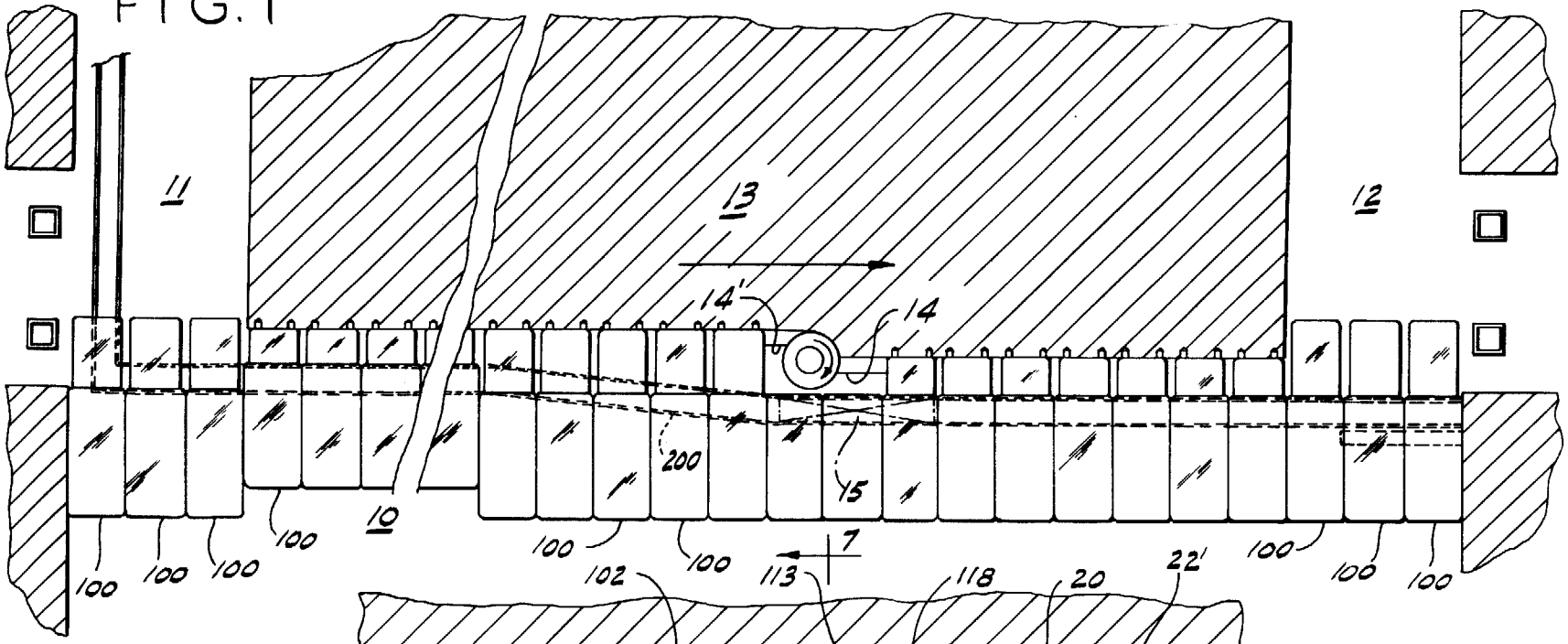
FIG. 1 is a plan view of a longwall mining system illustrating a kerf cutting ripper and telescoping roof supports.
Figure 2:
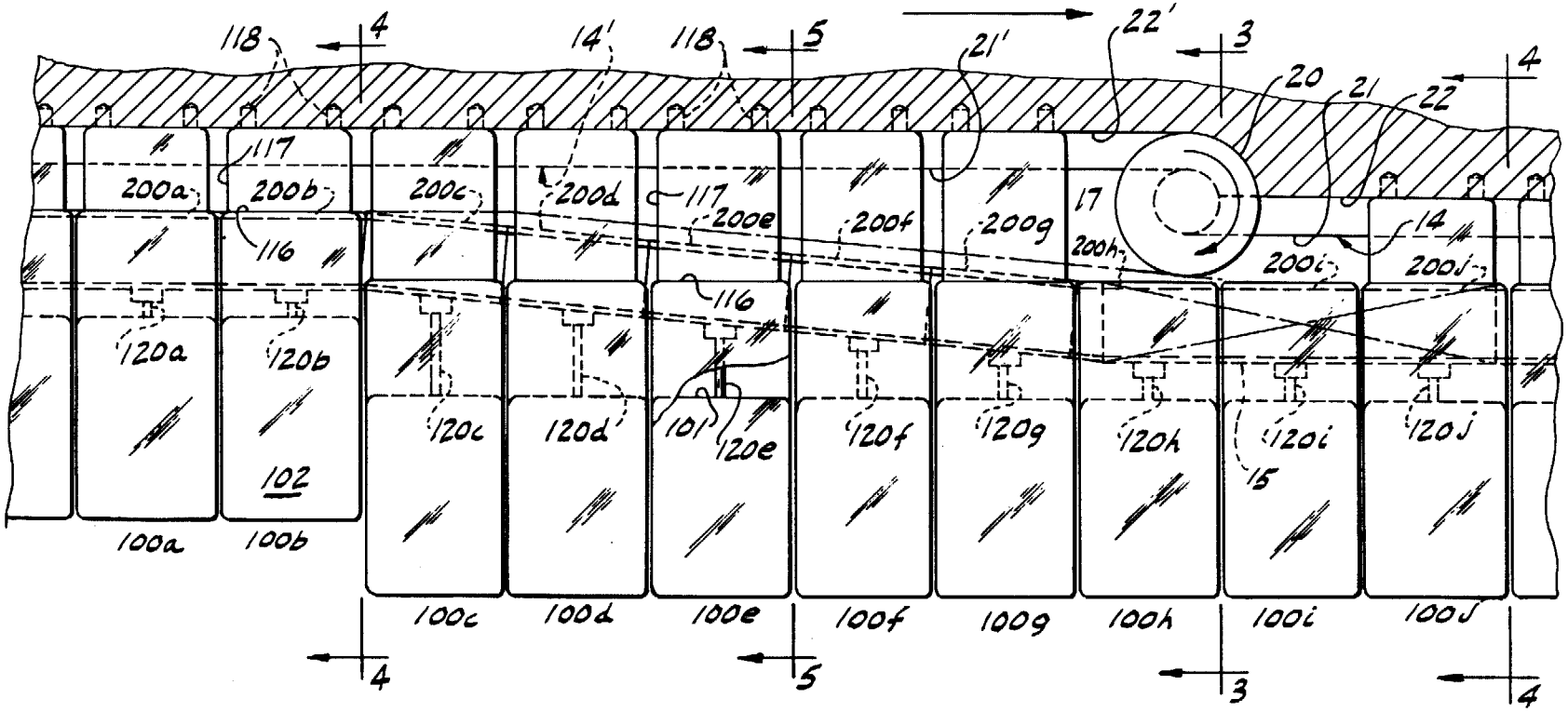
FIG. 2 is an enlarged, fragmentary plan view of the transitional portion of the support system.
Figure 4:
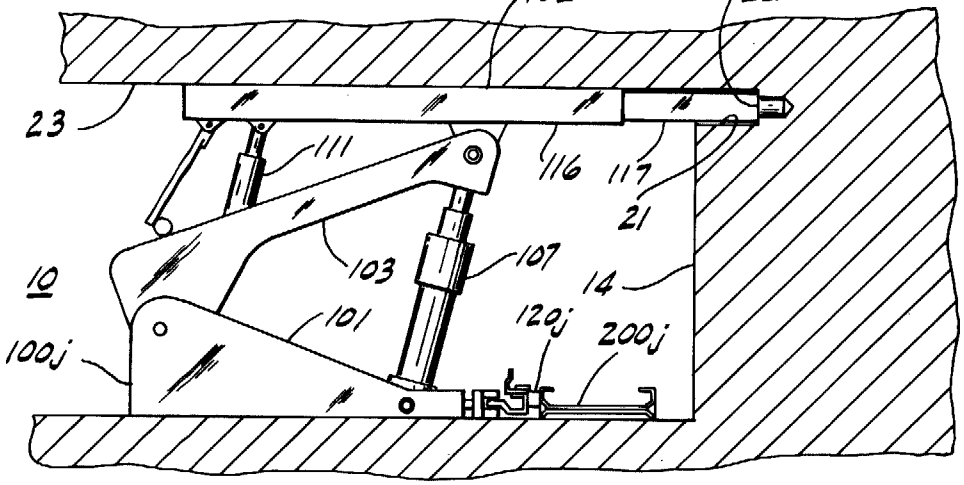
FIG. 4 is a cross-sectional view taken on line 4—4 of FIG. 2 illustrating the telescoping support in a partially extended condition.
Figure 5:
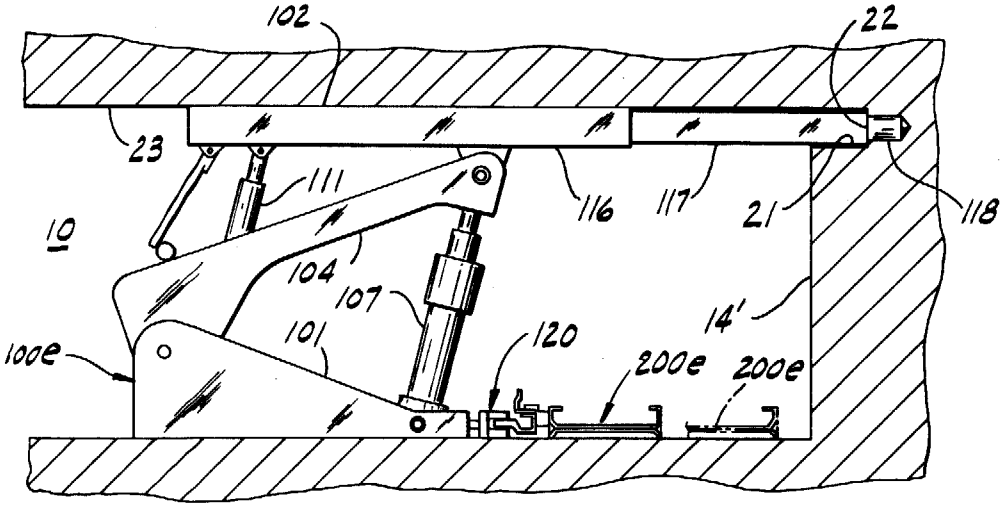
FIG. 5 is a cross-sectional view taken on line 5—5 of FIG. 2 illustrating the telescoping support in a fully extended condition.

Referring now by reference numerals to the drawings and first to FIGS. 1, 2 and 4, it will be understood that the longwall passage is indicated by numeral 10 and is flanked by passages 11 and 12 to define a coal area 13 which is to be removed. The removal of coal from the longwall face 14 is accomplished, in the embodiment shown, by means of a continuous mining machine generally indicated by numeral 15 having a support and drive assembly 16 for driving a rotary ripper 17 having a vertical axis of rotation. A rotary kerf cutter 20 is coaxially disposed above the rotary ripper 17 and, as shown in FIG. 1, is driven by the support and drive assembly 16, to cut a continuous kerf 21 into the upper part of the wall face 14 during passage of the ripper 17, said kerf constituting a ledge means.

During the removal of coal from the longwall face 14 the roof 23 is supported by means of a plurality of telescopic support assemblies 100 which are identical in structure and which are distinguished as to location by suffixes *a, b,* etc., in FIG. 2, for convenience in describing the operation.

The continuous mining machine 15 rides alongside the longwall 14 on a track which, in the preferred embodiment, forms an integral part of a conveyor system which consists of a plurality of link-connected articulated sections 200. The sections 200 are disposed adjacent associated support assemblies 100 and are distinguished as to location by corresponding suffixes, *a, b,* etc.

Figure 3:
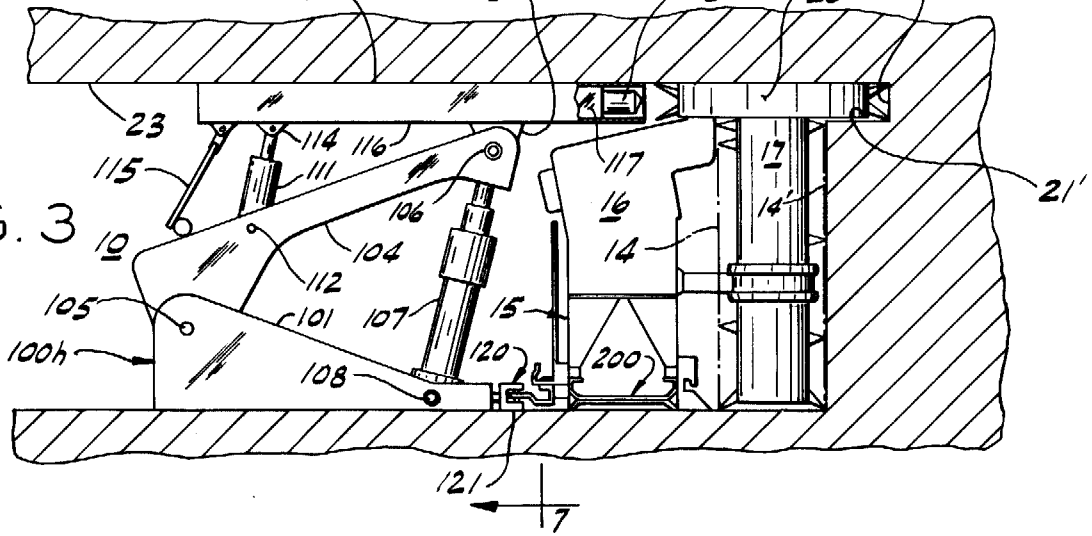
FIG. 3 is a cross-sectional view taken on line 3—3 of FIG. 2 illustrating a telescoping support in a fully retracted condition.
Figure 7:
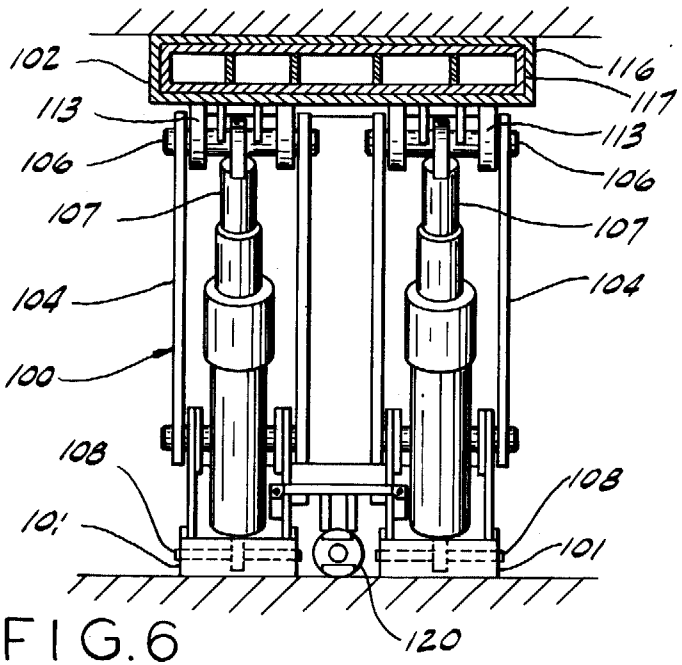
FIG. 7 is a cross-sectional view of the support taken on line 7—7 of FIG. 4.

The support assemblies 100 are best understood by reference to FIGS. 3 and 7. As shown, each assembly 100 includes a pair of interconnected base units 101, constituting a base means, and a shield unit 102. The shield unit 102 is connected to the base units 101 by means of a jacking system which permits the shield unit 102 to be elevated into a roof supporting condition. In the embodiment shown the jacking system consists essentially of a pair of inclined arms 104 pivoted to associated base units 101 at 105, each arm 104 being pivotally connected at its outer end at 106 to the upper end of an associated piston and cylinder assembly 107 which is pivotally connected to associated base assembly 101 at 110. A second pair of piston and cylinder assemblies 111 is pivotally connected to associated arms 104 at 112. The shield unit 102 includes front and rear brackets 113 and 114 by which the piston and cylinder assemblies 107 and 111 are operatively connected to the shield unit 102. A guard unit 115 pivotally mounted to the rear of the shield unit 102 protects the rear end of the support assembly from falling roof material. The base units 101 of each support assembly 100 provide a fixed mounting for a ram 120 which extends between each support assembly 100 and is connected at 121 to its associated conveyor section 200 so that said support assembly and said conveyor section can be moved relative to each other.

Figure 6:
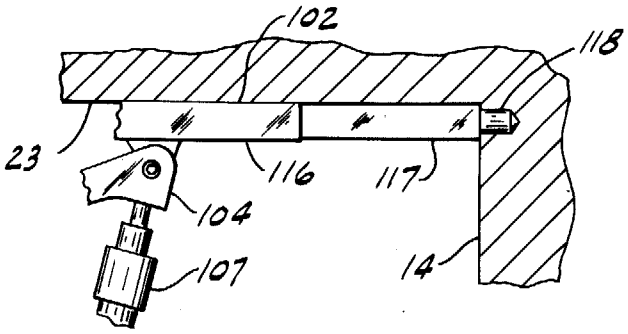
FIG. 6 is a fragmentary cross-sectional view, similar to FIG. 5, illustrating a modified wall engagement condition of the outer end of the roof support.

Each shield unit 102 includes an outer casing 116, constituting a primary support means, and a telescopically related inner casing 117, which constitutes a secondary support means. It will be understood that the inner casing 116 can be extended relative to the outer casing 117 by means of a hydraulic piston and cylinder (not shown). In the embodiment shown in FIG. 3 the inner casing includes a point 118 at the outer end which can be driven into the rear face 22 of the kerf 21 to provide additional support for said inner casing to that provided by the kerf 21. Alternatively, as shown in FIG. 6, the point 118 can be driven into the corner portion of the face 14 in those instances in which a kerf is not provided. Importantly, in either case, the provision of a bearing support for the outer end of the inner casing ensures that the inner casing 17 is supported at each end that is at the outer casing end and the wall end in the manner of a simple beam, rather than at the casing end only as would be the case with a purely cantilever structural arrangement.

The nature of the roof support system provides that the roof closely adjacent the wall face 14 is supported at all points by the telescopic inner casing 117 except for the area in the immediate vicinity of the ripper 17 and the kerf cutter 20. The operation of the system will now be described with reference to FIG. 2 and FIGS. 3–5, it being understood that FIG. 2 is an enlarged view of the transitional portion of the longwall support system.

Just before the rotary ripper 17 and the kerf cutter 20 are moved into the vicinity of the individual support assemblies, for example assembly 100*i*, the inner casing 117 of said assembly is fully retracted as shown in FIGS. 2 and 3.

As shown in FIGS. 2 and 4, the roof 23 ahead of the kerf cutter 20 is fully supported by support assembly 100*j*. As the cutter 20 moves into the immediate vicinity of an assembly, that assembly is fully retracted until the cutter has passed by. Thus, in FIG. 2 assemblies 100h and 100i are shown in the fully retracted condition. When the cutter has passed by an assembly, for example assembly 100g, the inner casing 116 of that assembly is fully extended into a position in which it is supported by the kerf 211. It will be observed that the conveyor sections 200h–200j are parallel to the wall face 14 and conveyor sections 200a and 200b are parallel to wall face 14. The conveyor sections 100a–100g between these two parallel lengths form a transition length. The transition length depends on the permissible angle which can be reasonably formed by the articulate connection between consecutive conveyor sections and, as shown in FIG. 2, the transition length consists of five sections. When the kerf cutter 20 is sufficiently clear of conveyor section 100h, the support assembly ram 12h connected to this section, together with rams 120c–120g connected to sections 200c–200g, are extended incrementally so that the transition length takes up a new position as shown in phantom outline. Following this, the shield unit associated with support assembly 100c can be lowered slightly out of engagement with the roof 23 to relieve the roof load bearing upon this unit. When this is done the ram 120c only is retracted so that the base of the support assembly 100c is drawn toward the conveyor section 200c with the result that the associated inner and outer casings 116 and 117 of the shield unit are relatively telescoped and the support assembly 100c assumes the same relationship of parts as support assemblies 100a and 100b. The reaction of the ram 120c to allow movement of the base of the support unit 100c toward the conveyor section 200c is made possible by the fact that this section is held effectively fixed in position by virtue of the support assemblies 100b and 100d on opposite sides of conveyor section 100c, which assemblies are themselves fixed by virtue of carrying their share of the roof load. Once the relocation of support assembly 100c is achieved, the associated shield unit is raised slightly so that this assembly again carries its portion of the roof load.

In this way the transition portion of the conveyor, in effect, follows the rotary kerf cutter 18 as it moves down the longwall face.

The support system described above can be readily adapted for use in conjunction with a continuous mining machine having a ranging drum shearer using a two pass procedure rather than a vertically oriented rotary ripper. The use of this type of mining machine and procedure followed will now be described with reference to FIGS. 8–11, it being understood that the support system and conveyor system are unchanged.

The machine 315 includes a support and drive assembly 316 for driving a drum shearer 317 having a horizontal axis of rotation and a follower kerf cutter 320 having a vertical axis of rotation.

Figure 9:
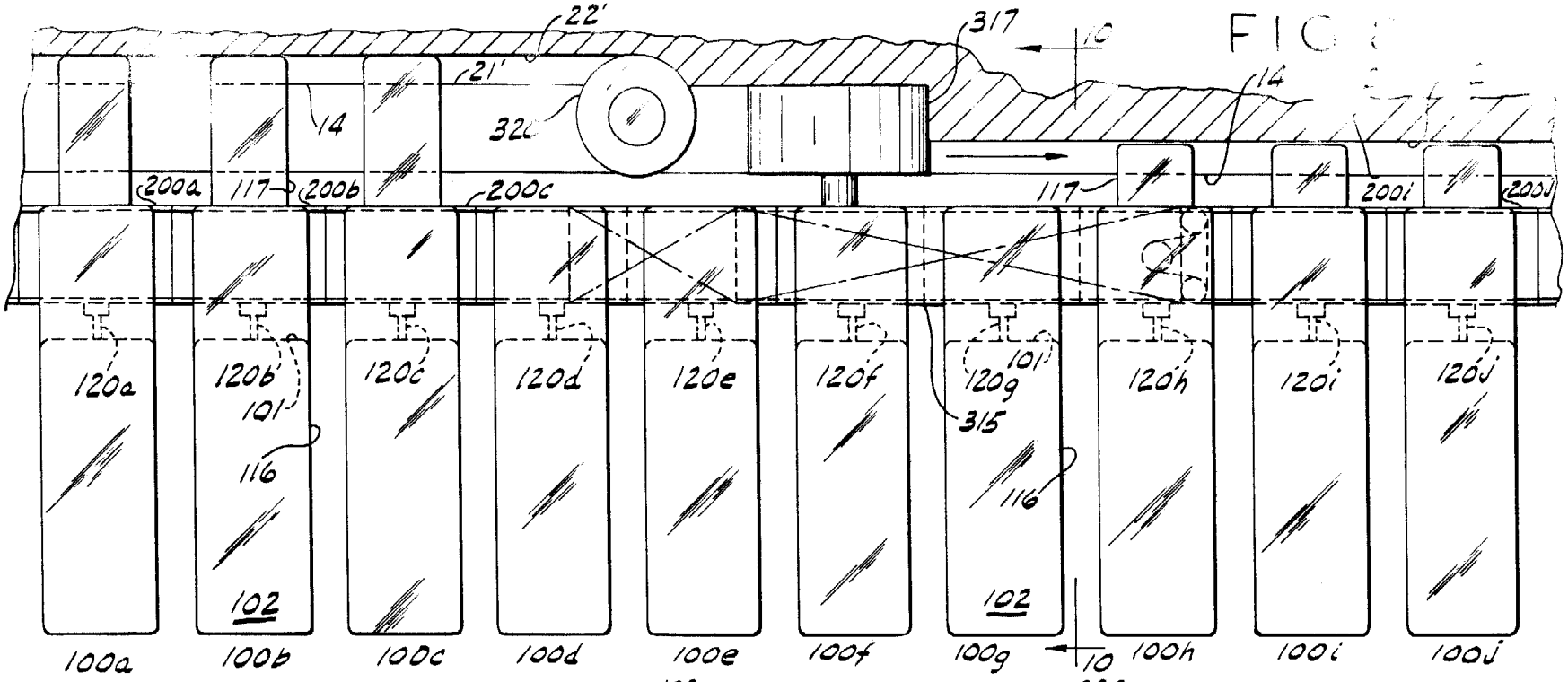
FIG. 9 is a similar view illustrating the return pass.
Figure 10:
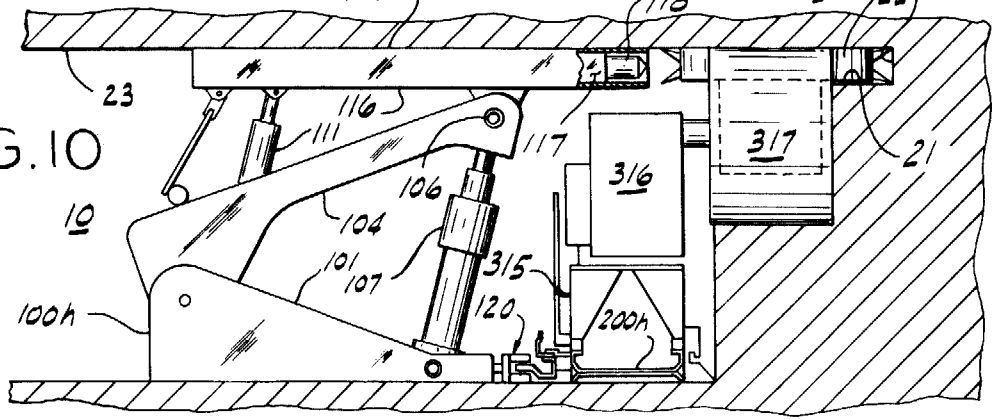
FIG. 10 is a cross-sectional view taken on line 10—10 of FIG. 8 illustrating the telescoping support in a retracted condition during the first pass.
Figures 9, 11:
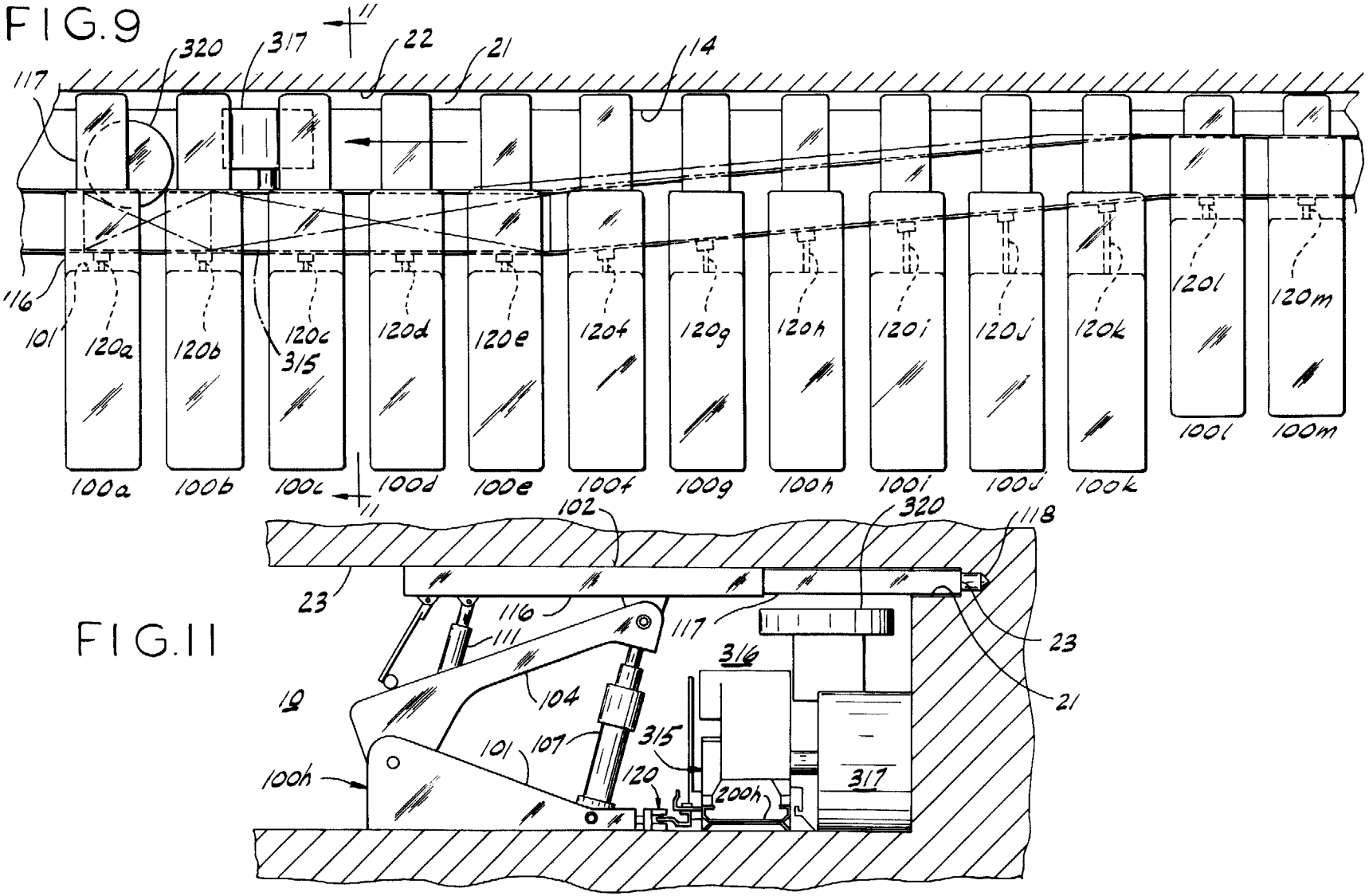
FIG. 11 is a similar view taken on line 11—11 of FIG. 9 illustrating the telescoping support in an extended condition and showing the kerf cutter in the lowered condition during the return pass.

During the first pass, as shown in FIG. 8, the inner casings 116 of support assemblies 100d–100g are fully retracted to permit the drum shearer 317 and follower 320 to pass. The roof 23 ahead of the drum shearer 317 is fully supported by assemblies 100h–100j. As the kerf cutter 320 passes by assembly 100c the inner casing of that assembly is fully extended into a position in which it is supported by kerf 21. The second or return pass is shown in FIG. 9 which illustrates a transitional portion of the conveyor system lagging the mining machine 315. During the second pass the shearer 317 is working the lower half of the wall face 14 and is therefore well below the elevation of the extended inner casing 117 of the support assembly shield unit 102 as shown in FIG. 11. The kerf cutter 327 is provided with means which permit it to be moved to one side and lowered (FIG. 11) and is therefore also clear of the inner casings 116 of the support assembly 100. In consequence, mining machine 315 passes freely under the extended assemblies 100a–100e and as the rear of said machine passes the transitional portion of the conveyor, i.e. conveyor sections 200f–200k these sections can be incrementally moved toward the wall face 14 as indicated in phantom outline. The shield unit 102 of the support assembly 100k at the end of the transitional portion of the conveyor assembly is lowered out of engagement with the roof 23 and the support assembly 100k can be pulled toward the conveyor section 200k by the ram 102k exactly in the same manner as described above.

I claim:

1. A mine roof support and conveyor system for longwall mining comprising:

(a) base means, (b) roof support means including:

(1) a primary support means, and (2) a secondary support means mounted in extensible relation to the primary support means and having wall engagement means at the outer end said wall engagement means transferring part of the roof load to the wall, (c) jacking means between the base means and the roof support means for elevating the said support means into support engagement with the roof, (d) conveyor means between the base means and the longwall, (e) ram means operatively interconnecting the conveyor means to the base means for urging the conveyor means toward the longwall when the base means is fixed relative to the longwall and for urging the base means toward the longwall when the conveyor means is fixed.

2. A mine roof support and conveyor system as defined in claim 1, in which:

(f) the wall engagement means includes a tapered end point to facilitate driving said means into the wall.

3. In a longwall mining system:

(a) a continuous mining machine, (b) a plurality of mine roof supports, each including:

(1) base means including ram means, (2) a primary support means, and a secondary support means mounted to the primary support means in extensible relation and having wall engagement means at the outer end said wall engagement means transferring part of the roof load to the wall, and (3) jacking means between the base means and the primary support means for elevating the primary support means into support engagement with the roof, (c) conveyor means including a plurality of conveyor sections linked together in articulated relation, and (d) each conveyor section being operatively connected to an associated ram means for movement of said conveyor section toward the longwall when the associated base means is fixed in position and for movement of the base means toward the longwall when the conveyor section is fixed in position.

4. A longwall mining system as defined in claim 3, in which:

(e) the conveyor section is fixed in position by adjacent conveyor sections on each side thereof said adjacent sections being fixed by associated base means through the medium of the ram means.

5. A longwall mining system as defined in claim 3, in which:

(e) the continuous mining machine includes a rotary kerf cutting means creating a bearing ledge along the upper portion of the longwall, and (f) the wall engagement means at the outer end of the secondary support means is movable into bearing engagement with the bearing ledge.

6. A longwall mining system as defined in claim 3, in which:

(e) the continuous mining machine includes a double pass drum cutter means having a vertically movable horizontal axis of rotation, and a cylindrical kerf cutter means having a vertical axis of rotation spaced lengthwise from said horizontal axis of rotation and creating a bearing ledge supporting said wall engagement means.

7. A longwall mining system as defined in claim 3, in which:

(e) the wall engagement means includes a tapered end point to facilitate driving entry of said means into the wall as the secondary support means is extended.

8. A longwall mining system as defined in claim 3, in which:

(e) the continuous mining machine includes a single pass drum cutter means engageable with the longwall and having a vertical axis of rotation.

9. A longwall mining system as defined in claim 8, in which:

(f) the drum cutter means has an enlarged upper end portion providing a kerf cutting means creating a bearing ledge supporting said wall engagement means.

10. In a longwall mining system:

(a) a continuous mining machine, (b) a plurality of mine roof supports, each including:

(1) base means including ram means, (2) a primary support means, and a secondary support means mounted to the primary support means in extensible relation and having wall engagement means at the outer end, and (3) jacking means between the base means and the primary support means for elevating the primary support means into support engagement with the roof, (c) conveyor means including a plurality of conveyor sections linked together in articulated relation, (d) each conveyor section being operatively connected to an associated ram means for movement of said conveyor section toward the longwall when the associated base means is fixed in position and for movement of the base means toward the longwall when the conveyor section is fixed in position, and (e) the continuous miner including kerf cutting means creating a bearing ledge along the upper portion of the longwall supporting said wall engagement means, and being provided by a cylindrical member having a vertical axis of rotation.

11. A method of supporting a roof during a continuous mining operation comprising the steps of:

(a) laying an articulated conveyor adjacent the longwall face, (b) supporting the roof adjacent the longwall by a plurality of extensible roof supports, (c) cutting the longwall face with a continuous mining machine traveling lengthwise on the articulated conveyor, (d) extending the roof support beyond the newly cut longwall face and into supporting engagement with the longwall after the machine has passed and unassisted by support from the machine so that the longwall assists in supporting the roof and substantially reduces the load concentration on the mine floor, and (e) progressively relocating the conveyor sections into closer adjacency with the newly cut longwall face when the machine has passed.

12. A method of supporting a roof as defined in claim 11, including the additional steps of:

(f) cutting a kerf into the upper portion of the longwall face with the continuous mining machine, and (g) extending the roof support into bearing engagement within the kerf unassisted by support from the mining machine.

13. A method of supporting a roof during a two pass continuous mining operation comprising the steps of:

(a) laying an articulated conveyor adjacent the longwall face, (b) supporting the roof adjacent the longwall face by a plurality of extensible roof supports, (c) making a first upper pass with a continuous mining machine traveling lengthwise on the articulated conveyor, (d) extending the roof support beyond the newly cut longwall face and into supporting engagement with the longwall after the machine has passed unassisted by support from the machine so that the longwall assists in supporting the roof and substantially reduces the load concentration on the mine floor, (e) making a return lower pass with the continuous mining machine traveling lengthwise on the articulated conveyor, and (f) progressively relocating the conveyor sections into closer adjacency with the newly cut longwall face when the machine has passed.

14. A method of supporting a roof as defined in claim 13, including the additional steps of:

(g) cutting a kerf into the upper portion of the longwall face with the continuous mining machine during the first pass, and (h) extending the roof support into bearing engagement within the kerf unassisted by support from the mining machine.

* * * * *